US009945123B2

(12) United States Patent
Peltonen et al.

(10) Patent No.: US 9,945,123 B2
(45) Date of Patent: Apr. 17, 2018

(54) STEEL BEAM

(71) Applicant: PEIKKO GROUP OY, Lahti (FI)

(72) Inventors: Simo Peltonen, Kouvola (FI); Pavel Nadasky, Lahti (FI)

(73) Assignee: PEIKKO GROUP OY, Lahti (FI)

( * ) Notice: Subject to any disclaimer, the term of this patent is extended or adjusted under 35 U.S.C. 154(b) by 0 days.

(21) Appl. No.: 15/701,590

(22) Filed: Sep. 12, 2017

(65) Prior Publication Data

US 2018/0080227 A1 Mar. 22, 2018

(30) Foreign Application Priority Data

Sep. 16, 2016 (FI) ..... 20165694

(51) Int. Cl.
*E04C 3/02* (2006.01)
*E04C 5/00* (2006.01)
(Continued)

(52) U.S. Cl.
CPC ..... *E04C 5/0604* (2013.01); *E04B 1/14* (2013.01); *E04B 1/30* (2013.01); *E04C 3/20* (2013.01);
(Continued)

(58) Field of Classification Search
CPC ..... E04C 5/0604; E04C 2003/0443; E04C 2003/0439; E04C 2003/043; E04C 3/34;
(Continued)

(56) References Cited

U.S. PATENT DOCUMENTS 1,090,171 A * 3/1914 Schisler ..... 138/115
2,198,985 A * 4/1940 Bailey ..... E02D 5/665 405/253
(Continued)

FOREIGN PATENT DOCUMENTS

CN 103 850 392 B 1/2016
DE 202 15 502 U1 1/2003
(Continued)

OTHER PUBLICATIONS

Mar. 20, 2017 Search Report issued in Finnish Application No. 20165694.
(Continued)

*Primary Examiner* — Andrew J Triggs
(74) *Attorney, Agent, or Firm* — Oliff PLC

(57) ABSTRACT

A steel beam comprising a frame formed by a first web part, a second web part, a base plate and a horizontal top part. The first and second web part are arranged side by side at a distance from each other, and joined at a first end of the first web part and the second web part by the horizontal top part. The first and second web part are joined at a second end of the first web part and second web part by the base plate. The base plate, the first web part, the second web part and the horizontal top part are arranged to form a space that can be filled with concrete. The steel beam further comprises a hollow member arranged inside the space sealed to prevent concrete entering. The hollow member is attached to the frame for preventing movement in relation to the frame.

8 Claims, 1 Drawing Sheet

(51) Int. Cl.

| | |
|---|---|
| ***E04B 1/14*** | (2006.01) |
| ***E04B 1/30*** | (2006.01) |
| ***E04C 5/06*** | (2006.01) |
| ***E04C 3/20*** | (2006.01) |
| ***E04C 3/293*** | (2006.01) |
| *E04C 3/04* | (2006.01) |

(52) U.S. Cl.
CPC ..... *E04C 3/293* (2013.01); *E04C 2003/043* (2013.01); *E04C 2003/0408* (2013.01); *E04C 2003/0439* (2013.01); *E04C 2003/0443* (2013.01)

(58) Field of Classification Search
CPC .... E04C 3/293; E04C 3/20; E04C 2003/0408; E04B 1/14; E04B 1/30
See application file for complete search history.

(56) References Cited

U.S. PATENT DOCUMENTS

| | | | | |
|---|---|---|---|---|
| 3,127,702 | A * | 4/1964 | Karstedt | B28B 23/00 249/83 |
| 3,858,374 | A | 1/1975 | Ben-Zvi | |
| 4,018,055 | A * | 4/1977 | Le Clercq | E02D 5/30 405/257 |
| 4,683,019 | A * | 7/1987 | Motoki | E04B 1/944 106/601 |
| 5,572,832 | A * | 11/1996 | Haavisto | E04C 3/04 52/1 |
| 9,267,286 | B2 * | 2/2016 | Kim | E04C 3/34 |
| 2006/0005503 | A1 * | 1/2006 | Bladow | B62D 21/15 156/130.7 |
| 2006/0070338 | A1 * | 4/2006 | Pantelides | E04C 3/34 52/847 |
| 2012/0124937 | A1 * | 5/2012 | Teng | E04B 5/43 52/834 |
| 2016/0258160 | A1 * | 9/2016 | Radhouane | E04C 3/29 |

FOREIGN PATENT DOCUMENTS

| | | | |
|---|---|---|---|
| EP | 1 690 999 | A2 | 8/2006 |
| EP | 1978173 | A2 | 10/2008 |
| JP | H03-051462 | A | 3/1991 |
| KR | 101144586 | B1 | 5/2012 |
| KR | 20120133657 | A | 12/2012 |
| WO | 03/100185 | A1 | 12/2003 |
| WO | 03/100187 | A1 | 12/2003 |

OTHER PUBLICATIONS

Feb. 1, 2018 Search Report issued in European Patent Application No. 17 19 0804.

* cited by examiner

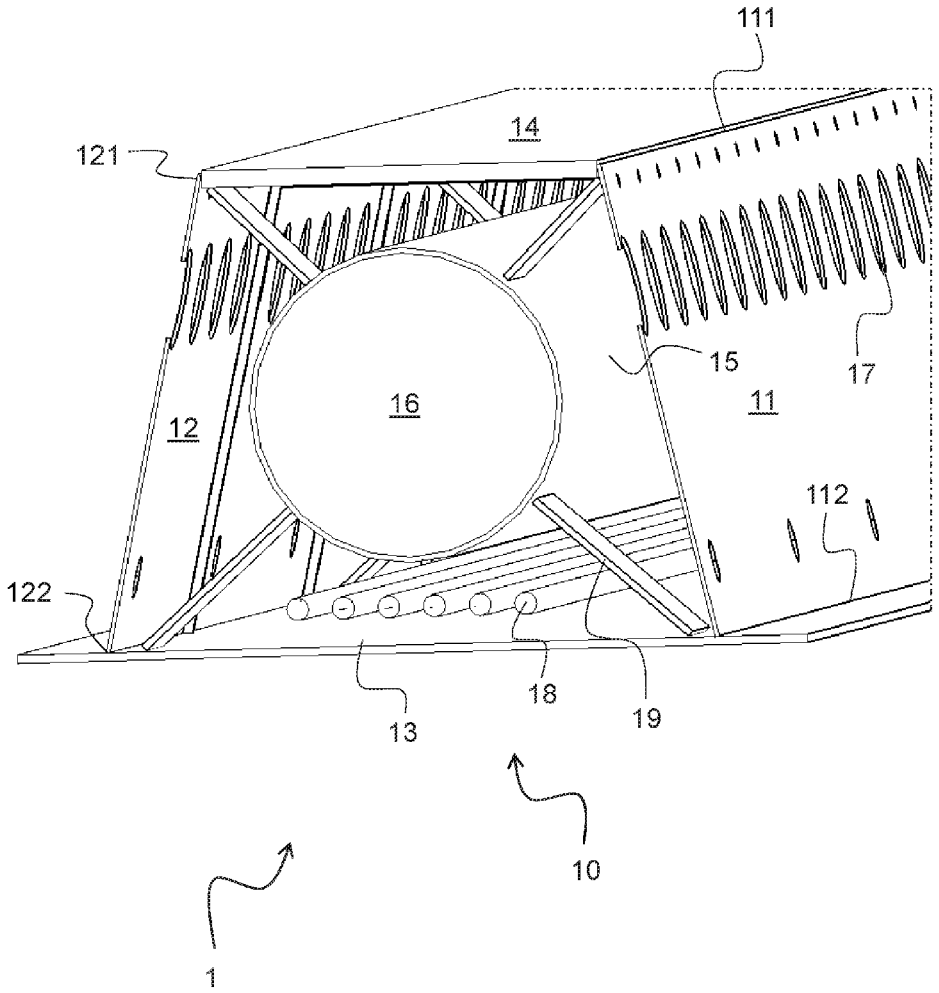
111
14
121
15
17
16
12
11
112
122
18
13
19
10
1

STEEL BEAM

FIELD OF THE DISCLOSURE

The present disclosure relates to construction elements, and particularly to steel beams.

BACKGROUND OF THE DISCLOSURE

Document WO03100185 discloses a steel beam arranged to serve together with concrete as a bearing composite structure for various slab systems, the composite structure comprising a base plate and two web parts arranged side by side at a distance from each other and joined at first ends by means of a horizontal top part. The base plate, web parts and horizontal top part are arranged to form a space that can be filled with concrete. At least one web part is made of a plate part formed of two longitudinal parts of the beam that are at an angle to each other. The plate part is fastened to the base plate and top part in such a manner that the lower part of the web part is at an angle to the base plate and the upper part is substantially perpendicular to the base plate.

Document WO03100187 discloses a steel beam that is arranged to serve together with concrete as a bearing composite structure for various slab systems, the composite structure comprising a base plate and two web parts arranged side by side at a distance from each other and joined at first ends of the web parts by means of a horizontal top part, whereby the base plate, web parts and horizontal top part are arranged to form a space that can be filled with concrete. One web part is in a manner known per se made slanted relative to the base plate and a corbel flange extending from it and equipped with openings. The other web part is, in turn, made substantially perpendicular to the base plate and has no openings.

A problem with the above mentioned structures is that when the steel beam is filled with concrete for forming a bearing composite structure, the resulting beam is very heavy. It is also required to give the concrete sufficient time to cure, which has to be taken into account in the construction schedule.

BRIEF DESCRIPTION OF THE DISCLOSURE

An object of the present disclosure is to provide a steel beam so as to overcome the above problems.

The objects of the disclosure are achieved by a steel beam which is characterized by what is stated in the independent claims. The preferred embodiments of the disclosure are disclosed in the dependent claims.

The disclosure is based on the idea of providing a steel beam comprising a space to be filled with concrete where a hollow member is arranged inside the space to replace concrete with the hollow member. In other words the hollow member provides a void inside the concrete.

An advantage of the steel beam of the disclosure is that the weight of the finished composite structure is lower, the required amount of concrete is smaller, and the casting time and the drying time of the concrete are shorter. Therefore overall costs of the finished composite structure is made smaller.

BRIEF DESCRIPTION OF THE DRAWINGS

In the following the disclosure will be described in greater detail by means of preferred embodiments with reference to the accompanying drawings, in which FIG. 1 illustrates a section of a steel beam according to an embodiment of the disclosure.

DETAILED DESCRIPTION OF THE DISCLOSURE

The disclosure relates to a steel beam 1 that is arranged to serve together with concrete as a bearing composite structure for various slab systems.

The steel beam 1 comprises a frame 10 formed by a first web part 11, a second web part 12, a base plate 13 and a horizontal top part 14. The first web part 11 and the second web part 12 are arranged side by side at a distance from each other and longitudinally parallel, i.e. parallel in relation to their length.

The first web part 11 and the second web part 12 are joined at a first end 111 of the first web part 11 and a first end 121 of the second web part 12 by means of the horizontal top part 14. The first web part 11 and the second web part 12 are joined at a second end 112 of the first web part 11 and a second end 122 of the second web part 12 by means of the base plate 13.

The base plate 13, the first web part 11, the second web part 12 and the horizontal top part 14 are arranged to form a space 15 that can be filled with concrete. When the space 15 is filled with concrete, the composite structure is obtained. The steel beam 1 comprises a hollow member 16 arranged inside the space 15. Optionally the steel beam 1 comprises a plurality of hollow members 16 arranged along the length of the steel beam 1 inside the space 15. The hollow member 16 is sealed so that penetration of concrete into the hollow member 16 is prevented when the steel beam 1 is filled with concrete. Preferably the hollow member 16 is empty, i.e. an inner space of the hollow member 16 comprises mostly air. The hollow member 16 can also be filled at least partly with a foam or other material having a density lower than concrete.

The hollow member 16 is attached to the frame 10 for preventing movement of the hollow member 16 in relation to the frame 10. Without the attachment the hollow member 16 could move for example because of the uplift caused by the fresh concrete when casting. According to an embodiment the cross section of the frame 10 forms a quadrangular shape and the hollow member 16 is attached to each corner of the quadrangular shape using connecting pieces 19, one end of each being attached to the hollow member 16 and another end of each being attached to the respective corner of the quadrangular shape. According to another embodiment the hollow member 16 is attached to the frame by a metal sheet having one edge attached to one of the base plate 13, first web part 11, second web part 12 and horizontal top plate 14, and an opposite edge attached to the hollow member 16.

According to an embodiment the first web part 11 and/or the second web part 12 comprises openings 17 for filling the space 15 with concrete through the openings 17.

According to an embodiment the steel beam 1 comprises reinforcement bars 18 arranged inside the space 15. Preferably the reinforcement bars 18 are arranged closer to the base plate 13 than to the horizontal top plate. For example the reinforcement bars 18 are arranged between the base plate 13 and the hollow member 16.

According to an embodiment the first web part 11 and/or the second web part 12 is arranged to form an angle with the base plate 13, wherein the angle differs from 90°. In other words the first web part 11 and/or the second web part 12 is in a manner known per se made slanted relative to the base plate 13.

The shell of the hollow member must be able to withstand the hydrostatic pressure caused by the fresh concrete and the reaction forces from the connection elements. According to an embodiment the hollow member 16 comprises a tube. Preferably the tube is capped at each end of the tube. For example the tube is a round tube or a square tube.

According to an embodiment the steel beam 1 comprises an imaginary axis, that is parallel with the steel beam 1 and arranged at half way between the base plate 13 and the horizontal top part 14, and the hollow member 16 is arranged parallel with the imaginary axis and the hollow member 16 is arranged to enclose the imaginary axis.

According to an embodiment the hollow member 16 is made of structural steel. Then the hollow member 16 can be taken into account as a reinforcement of the beam. Thus the loss in strength of the composite structure caused by the missing concrete replaced by the hollow member 16 is at least partly compensated by the strength of the hollow member 16. If the hollow member is strong enough, it is possible to reduce the thickness of the base plate 13 and/or the horizontal top part 14 and/or reduce the number of the reinforcement bars 18.

The invention claimed is:

1. A steel beam that is arranged to serve together with concrete as a bearing composite structure for various slab systems, wherein the steel beam comprises a frame formed by a first web part, a second web part, a base plate and a horizontal top part, the first web part and the second web part are arranged side by side at a distance from each other, the first web part and the second web part are joined at a first end of the first web part and a first end of the second web part by means of the horizontal top part, the first web part and the second web part are joined at a second end of the first web part and a second end of the second web part by means of the base plate, the base plate, the first web part, the second web part and the horizontal top part are arranged to form a space that can be filled with concrete, wherein the steel beam further comprises a hollow member arranged inside the space, the hollow member is sealed so that penetration of concrete into the hollow member is prevented when the steel beam is filled with concrete, the hollow member is attached to the frame for preventing movement of the hollow member in relation to the frame, wherein the cross section of the frame forms a quadrangular shape and the hollow member is attached to each corner of the quadrangular shape using connecting pieces, one end of each being attached to the hollow member and another end of each being attached to the respective corner of the quadrangular shape.

2. A steel beam according to claim 1, wherein the first web part and/or the second web part comprises openings.

3. A steel beam according to claim 1, wherein the steel beam comprises reinforcement bars arranged inside the space.

4. A steel beam according to claim 3, wherein the reinforcement bars are arranged closer to the base plate than to the horizontal top plate.

5. A steel beam according to claim 1, wherein the first web part and/or the second web part is arranged to form an angle with the base plate, wherein the angle differs from 90°.

6. A steel beam according to claim 1, wherein the hollow member comprises a tube.

7. A steel beam according to claim 1, wherein the steel beam comprises an imaginary axis, that is parallel with the steel beam and arranged at half way between the base plate and the horizontal top part, and the hollow member is arranged parallel with the imaginary axis and the hollow member is arranged to enclose the imaginary axis.

8. A steel beam according to claim 1, wherein the hollow member is made of structural steel.

* * * * *